US005913503A

United States Patent [19]

Satoh et al.

[11] Patent Number: 5,913,503

[45] Date of Patent: Jun. 22, 1999

[54] ASEISMATIC MOUNT FOR EXHIBITON OF ARTICLES AND SHOWCASE EQUIPPED WITH ASEISMATIC MOUNT

[75] Inventors: Yukio Satoh, Nara-ken; Susumu Otsuka, Ryugasaki; Kunihiko Andoh, Yahata; Kunio Hayakawa, Tsukuba, all of Japan

[73] Assignees: Kabushiki Kaisha Okumuragumi, Osaka-Fu, Japan; Oiresu Kogyo Kabushiki Kaisha, Tokyo-To, Japan

[21] Appl. No.: 08/857,250

[22] Filed: May 16, 1997

[30] Foreign Application Priority Data

Mar. 31, 1997 [JP] Japan ..... 9-098428

[51] Int. Cl.[6] ..... F16M 1/00

[52] U.S. Cl. ..... 248/636; 52/167.5; 52/167.6; 248/562; 248/638

[58] Field of Search ..... 248/562, 619, 248/636, 638; 52/167.4, 167.5, 167.6

[56] References Cited

U.S. PATENT DOCUMENTS

| | | | |
|---|---|---|---|
| 2,359,036 | 9/1944 | Harper | 52/167.5 X |
| 4,596,373 | 6/1986 | Omi et al. | 248/638 X |
| 5,261,200 | 11/1993 | Sasaki et al. | 52/167.5 X |

FOREIGN PATENT DOCUMENTS

| | | | |
|---|---|---|---|
| 1239990 | 7/1960 | France | 248/638 |
| 58-124843 | 7/1983 | Japan | 248/638 |
| 4-107339 | 4/1992 | Japan | 248/638 |
| 4-113046 | 4/1992 | Japan | 248/638 |

*Primary Examiner*—Derek J. Berger
*Attorney, Agent, or Firm*—Ronald E. Greigg; Edwin E. Greigg

[57] ABSTRACT

An aseismatic mount for exhibition of articles comprising a lower mount frame, a middle mount frame, an upper mount frame for mounting exhibition articles thereon, aseismatic mount having rollers integrally on an axis each of which is shifted eccentrically to each other in up and down directions, said aseismatic mounts being interposed between the lower mount frame and the middle mount frame at plural positions, and further aseismatic mounts having the same construction as the aseismatic mounts, and interposed between the middle mount frame and the upper mount frame.

8 Claims, 14 Drawing Sheets

ASEISMATIC MOUNT FOR EXHIBITON OF ARTICLES AND SHOWCASE EQUIPPED WITH ASEISMATIC MOUNT

BACKGROUND OF THE INVENTION

1. Field of the Invention

This invention relates to an aseismatic mount for exhibition of articles and a showcase equipped with the aseismatic mount for protecting works of art from an earthquake disaster.

2. Prior Art

There are many exhibition mounts and showcases installed in art galleries, museums, temples and so on to exhibit excavated cultural inheritances, Buddist statues, such works of art as sculptures, etc. However, since these exhibition mounts and showcases are conventionally installed directly on floors of rooms, the exhibition mounts and showcases collapse and the exhibited articles as works of arts are damaged or broken, meaning serious loss that cannot be recovered, once an earthquake takes place. As a countermeasure, structures are made solid by, for example, making frameworks of exhibition mounts and showcases thick. However, the structures not only cost much but also are difficult to completely prevent collapse in case of a great earthquake. Therefore, an aseismatic equipment has been developed in which such elastic body as neo-plain rubber is installed between installation surfaces and exhibition mounts or showcases so that shaking energy can be absorbed and diminished by the shearing strain.

Since the level of horizontal displacement is low in case of a small earthquake, even such elastic body of the aseismatic equipment as above-mentioned can disminish the shaking energy. However, in case of a great earthquake when the level of horizontal displacement reaches as large as 30 cm, such elastic body as above-mentioned can not absorb the shaking energy of so great a displacement. Therefore, there exists a problem that most of the seismic waves are transmitted to the exhibition mounts and showcases via the elastic body, a consequence of which is that the exhibited objects and the whole showcases are overturned and great damages are incurred. Moreover, the aseismatic equipment installed with elastic body is exposed and visible, and does not harmonize with the exhibition mounts and the showcases, which damages the beauty of the exhibit as a whole. It may be considered that a board screen is installed at the bottom end of the exhibition mounts and the showcases to cover the aseistmatic equipment, however, there still exists a problem that it is difficult to maintain and inspect the aseismatic equipment.

SUMMARY OF THE INVENTION

This invention is made in view of the above-mentioned problems, and the purpose of the invention is to present an aseismatic mount for exhibition of articles and a showcase equipped with the aseismatic mount, in which the exhibition articles on the mount or the showcase itself and/or the exhibition articles contained therein are prevented from collapsing by disminishing a large horizontal shake without fail even in case of a great earthquake while making it easy to restore to the original position after the earthquake, and the outward appearance of the aseismatic mount and the showcase goes well with the surroundings while maintenance and inspection are easy to conduct.

To achieve the above object, the aseismatic mount for exhibition of articles such as artwork according to the present invention comprises, a lower mount frame, a middle mount frame, an upper mount frame for mounting exhibition articles thereon, aseismatic means having rollers integrally an axis of each of which rollers is shifted eccentrically with respect to one another in up and down directions, said aseismatic means being interposed between the lower mount frame and the middle mount frame at plural positions, so as to roll one of said rollers, which has the axis shifted eccentrically in an upward direction, in contact with the lower mount frame, and to roll the other roller, which has the axis shifted eccentrically in a downward direction, in contact with the middle mount frame, and further aseismatic means having the same construction as the said aseismatic means, said further aseismatic means being interposed between the middle mount frame and the upper mount frame at plural positions in such a way that the rolling directions of the rollers cross the said aseismatic means, so as to roll one of said rollers, which has the axis shifted eccentrically upwardly, in contact with the middle mount frame, and to roll the other roller, which has the axis shifted eccentrically downwardly, in contact with the upper mount frame.

The invention relates to the detailed construction of said aseismatic means of the aseismatic mount and in the upper mount frame, the middle mount frame and the lower mount frame, said aseismatic mount comprises an upper guide member fixed to the upper mount frame, a lower guide member fixed to the lower mount frame, a pair of the rollers interposed betwen the upper mount frame and the lower mount frame, each of said rollers having an axis which is shifted eccentrically with respect to one another in up and down directions, a rack provided integrally with an opposite face of each of the upper and lower guide members along the longitudinal direction of the guide members, a pinion provided integrally with one of the rollers having an axis shifted eccentrically upwardly, which roller rolls on the lower guide member, so as to engage with the rack of the lower guide member, and a further pinion provided integrally with the other roller having an axis shifted eccentrically downwardly, which roller rolls on the under surface of the upper guide member, so as to engage with the rack of the upper guide member.

As set forth herein, as a pair of the rollers of the aseismatic means, an axis of each of which is shifted eccentrically with respect to one another and formed integrally, it may adopt the construction for combining the roller of small diameter and the roller of large diameter which is shifted eccentrically to the roller of small diameter in up and down directions, or may adopt the construction for combining the rollers having the same diameter an axis of each of which is shifted eccentrically with respect to one another in up and down directions.

The invention relates to the construction of a preferable arrangment of the aseismatic means, wherein the lower mount frame, the middle mount frame, and the upper mount frame for mounting exhibition articles thereon, comprise a connecting member and an aseismatic means mount frame member which are combined in parallel crosses, in such a way that said aseismatic means is positioned at four corners where the connecting member and the aseismatic means mount frame member cross each other between the mount frames and opposite in up and down directions.

The invention relates to a showcase provided with aseismatic means wherein said showcase is mounted on the upper mount frame and the lower mount frame of the aseismatic amount for exhibition of articles is fixed onto an installation face.

In the showcase set forth, the invention further comprises a rectangular outer frame provided integrally with each of the lower mount frame, the middle mount frame and the upper mount frame of the aseismatic amount for exhibition of articles, said rectangular outer frame being formed in the same shape as the four walls of the showcase in plan view, so as to form a skirt portion of the showcase with these outer frames, and also form a clearance between the outer frames of the mount frames which are opposite in up and down direction, so as to allow the mount frame to move relatively in horizontal directions.

The invention relates to the supporting construction of the showcase using another construction of the showcase and said aseismatic means. The showcase comprises a main body of the showcase fixed to a wall of a structure and a mount plate for mounting exhibition articles which plate is separated from the showcase at the lower end of an opening of the main body of the showcase, said aseismatic means being positioned below the mount plate along the longitudinal direction of the mount plate leaving a predetermined distance therebetween, so as to support the mount plate by means of the upper mount frame of each of the aseismatic means.

Functions

The aseismatic means, interposed between the lower mount frame and the middle mount frame, and between the middle mount frame and the upper mount frame, is provided with rollers an axis of each of which is shifted eccentrically with respect to one another, and one of the rollers an axis of which is shifted eccentrically upwardly, is rolled in contact with the upper surface of the lower mount frame and the other roller an axis of which is shifted eccentrically downwardly is rolled in contact with the undersurface of the upper mount frame. Therefore, in the normal state, the axis of each of the eccentric rollers is positioned on a vertical line, so that the weights of the exhibition material and the showcase may be supported stably on the lower mount frame via the aseismatic means which lower mount is installed on the floor.

When the floor shakes horizontally due to the earthquake, the lower mount frame installed on the floor shakes in the same direction as the earthquake, and one of the eccentric rollers on the lower mount frame tends to roll in an opposite direction with respect to the lower mount frame about an axis of the other roller which is integral with the said roller, and the other roller tends to roll with respect to the undersurface of the middle mount frame integrally about an axis of the said eccentric roller. Thus, both of the rollers tend to roll in the directions for gradually increasing a half diameter from the rolling axis of the rollers to the rolling surface, and this tendency functions as a resistance for stopping roll of the rollers, and the weights of the exhibition articles and the showcase further increase the resistance, so as to stop rotation of both of the rollers.

Accordingly, the exhibition articles and the showcase supported by the aseismatic means tend to move horizontally in the same direction as the lateral movement of the lower mount frame due to the time lag until both of the eccentric rollers have stopped after the floor has shaken horizontally. However, at the time, since the floor vibrates or shakes in an opposite direction, the exhibition articles and the showcase swings little. In the case that the floor shakes in an opposite direction, damping function of vibration can be carried out by means of the eccentric rollers in the same manner as mentioned above. Further, since the aseismatic means is interposed between the middle mount frame and the upper mount frame to crosswise to the same aseismatic means which is interposed between the lower mount frame and the middle mount frame, it is possible to damp swing or shock of the exhibition articles and the showcase in the directions of front and rear or right and left.

Thus, the present invention acts to controls to reduce swing or shock of the exhibition articles by transmitting only the dampened vibration waves to the exhibition articles or the showcase while absorbing the horizontal vibration by means of a plurality of aseismatic means which comprise a pair of the eccentric rollers. The aseismatic means has a long frequency and does not resonate with resepct to the vibration of the earthquake, so that the vibration of the earthquake cannot be transmitted to the exhibition articles or the showcase as the upper structure.

The lower mount frame, the middle mount frame, and the upper mount frame for mounting exhibition articles thereon, comprise a connecting member and an aseismatic means mount frame member which are combined in parallel crosses, in such a state that said aseismatic means is positioned at four corners where the connecting member and the aseismatic means mount frame member lay crosswise to each other between the mount frames disposed oppositely in up and down directions. Therefore, the exhibition articles or the showcase may be mounted stably.

Further, since a rectangular outer frame, which is formed in the same shape as the four walls of the showcase in plan view, is provided integrally with each of the lower mount frame, the middle mount frame and the upper mount frame, so as to form a skirt portion of the showcase with these outer frames, the seismatic means arranged in the aseismatic mount may be hidden by those outer frames so that the seismatic mount may harmonize with the showcase as those outer frames comprise a part of the showcase. Moreover, since there is formed a clearance between the outer frames of the mount frames which are oppositely disposed in up and down directions, it becomes possible to relatively move the upper and lower mount frames smoothly in horizontal directions via the aseismatic means.

Furthermore, in the normal state of exhibition, the body of the showcase does not move as it is fixed to the wall of the structure even if it is pushed suddenly. Since the mount plate for mounting exhibition articles is formed independently of the body of the showcase, the aseismatic mount supporting the mount plate for mounting exhibition articles is not in danger of movement. In addition, at the time of earthquake, although the body of the showcase moves integrally with the wall of the structure, swing or shake of the mount plate for mounting exhibition articles can be controlled since the vibration of the mount plate in the directions of front and rear or right and left transmitted from the floor, is reduced by means of the aseismatic means of the aseismatic mount.

OBJECTS OF THE INVENTION

A principal object of the invention is to provide an aseismatic mount for exhibition of articles such as art works, which comprises a lower mount frame, a middle mount frame, an upper mount frame for mounting exhibition articles thereon, aseismatic means having rollers integrally an axis of each of which is shifted eccentrically one another in up and down directions, said aseismatic means being interposed between the lower mount frame and the middle mount frame at plural positions, so as to roll one of said rollers, which has the axis shifted eccentrically upwards, in contact with the lower mount frame, and to roll the other roller, which has the axis shifted eccentrically downwards, in contact with the middle mount frame, and further aseismatic means having the same construction as the said aseismatic means, said further aseismatic means being interposed between the middle mount frame and the upper mount frame at plural positions in such a way that the rolling directions of the rollers cross the said aseismatic means, so as to roll one of said rollers, which has the axis shifted eccentrically upwards, in contact with the middle mount frame, and to roll the other roller, which has the axis shifted eccentrically downwards, in contact with the upper mount frame.

Therefore, at the time of an earthquake, energy of horizontal vibration or shake in the directions of front and rear and right and left can be absorbed by means of pairs of the eccentric rollers which comprise aseismatic means, so that swing of the exhibited articles and the showcase mounted on the upper mount frame may be reduced greatly.

Further, the aseismatic means interposed between the lower mount frame and the middle mount frame and between the middle mount frame and the upper mount frame, is provided integrally with the rollers which are formed eccentrically to each other, and one of the rollers, which has the axis shifted eccentrically upwards, is rolled in contact with the lower mount frame, and further the other roller, which has the axis shifted eccentrically downwards, is rolled in contact with the middle mount frame. Therefore, in the normal state, the center of each of the eccentric rollers can be positioned on a vertical line, so that the load of the exhibition articles or the showcase may be supported stably on the lower mount frame installed on the floor via the aseismatic means.

It is another object of the present invention that the upper and lower guide members comprising the aseismatic means are attached to the mount frames which face each other in up and down directions, and a rack is provided integrally with the undersurface of a side of the upper guide member and with the upper surface of another side of the lower guide member. In addition, the eccentric roller is provided integrally with the pinion which engages with the rack of the lower guide member at the same axis as the roller, and with the pinion which engages with the rack of the upper guide member at the same axis of the other roller. Thereby, it may surely prevent both of the eccentric rollers from slipping with respect to the upper and lower guide members, so as to bring about aseismatic function while rolling all of the eccentric rollers of the aseismatic means with a common rolling speed.

Yet another object of the present invention provides that between the mount frames which face each other in up and down directions, the aseismatic means is arranged respectively at the four corners where the connecting members assembled in parallel cross the outer frames and the mounting frame for the aseismatic mean cross. Therefore, it is possible to stably mount the exhibition articles or the showcase on the aseismatic mount. Further, at the time of the earthquake it may generate a stable swing and when the earthquake ceases, the upper mount frame mounting the exhibition articles or the showcase may be surely restored to the original state.

It is still another object of the invention that each of the mount frames is provided with the rectangular outer frame which is in the same form as the four walls of the showcase in plan view, thus presenting an appearance that it comprises a part of the showcase, and the aseismatic means arranged in the frames may be hidden so as not to present a strange appearance, but to harmonize with the room. In addition, the aseismatic mount may be formed easily in proportion to the sizes of the exhibition articles or the size and shape of the showcase, so that it may present a serious and good appearance in harmony with the exhibition articles or the showcase.

Yet another object of the present invention presents a large scaled aseismatic showcase and in the normal state of exhibition, the showcase does not move even if it is pushed suddenly since the body of the showcase is fixed to the wall of the structure. In addition, since the plate for mounting the exhibition articles is formed independently of the showcase, at the time of the earthquake, swing and shake of the the plate for mounting the exhibition articles in the directions of front and rear and right and left transmitted from the floor, can be reduced by means of the aseismatic means of the aseismatic mount, though the body of the showcase swings and moves integrally with the wall. Therefore, the swing may be controlled so that the exhibition articles may be surely protected from shake and swing.

Other objects and advantages of the present invention will be apparent from the description of the detailed embodiments accompanying the following drawings.

BRIEF DESCRIPTION OF THE DRAWINGS

The drawings show embodiments of the present invention in which.

DETAILED DESCRIPTION OF THE EMBODIMENTS

Figure 1:
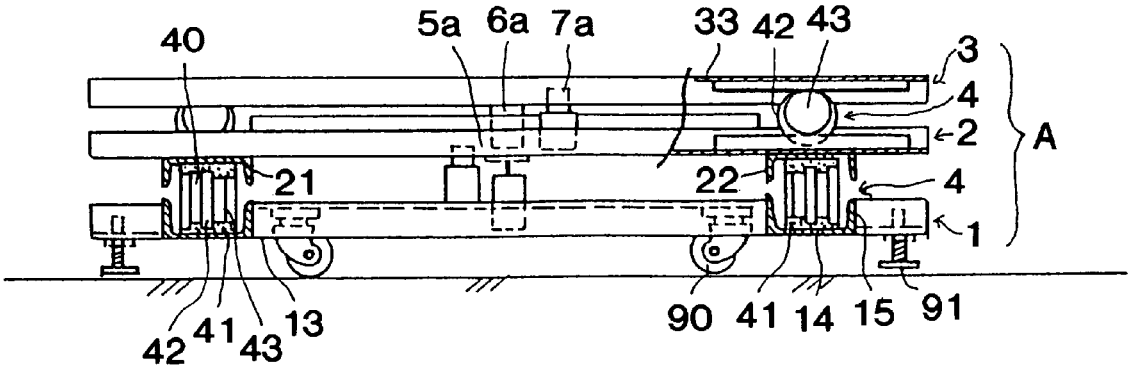
FIG. 1 is a front view partially broken of an aseismatic mount for mounting a showcase.
Figure 2:
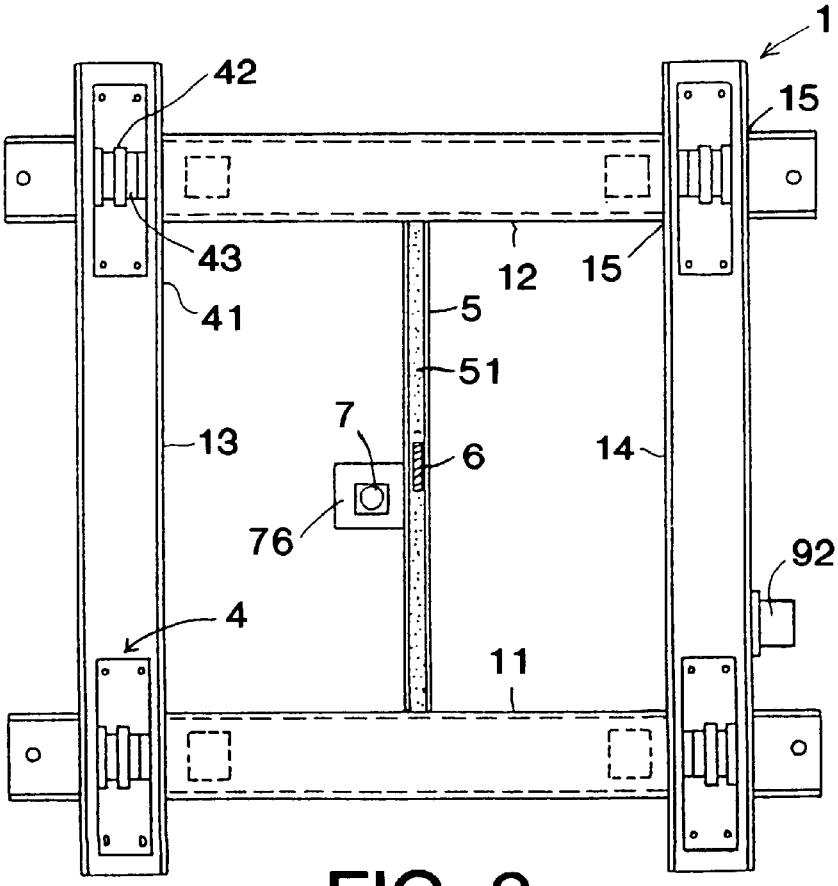
FIG. 2 is a plan view of a lower mount frame of the aseismatic mount.

Next, the actual embodiments of the present invention will be described with reference to the drawings. In FIG. 1, an aseismatic mount A comprises a lower mount frame 1, a middle mount frame 2 and an upper mount frame 3 which are superposed on each other leaving a distance therebetween, and aseismatic means 4 is interposed between the lower mount frame 1 and the middle mount frame 2, and between the middle mount frame 2 and the upper mount frame 3. As shown in FIG. 2, the lower mount frame 1 is assembled by front and rear connecting members 11 and 12, which are rectangular and parallel to each other, and right and left aseismatic means mount frame members 13 and 14, which are parallel to each other and made of steel channel members, in such a state that the connecting members 11 and 12 and the mount frame members 13 and 14 are fixed integrally in parallel crosses. Although these mount frame members 13 and 14, and the front and rear connecting members 11 and 12 are crossed at right angle, the connecting members 11 and 12 are cut with just the width of the mount frame members 13 and 14 at their crossing portions, and the crossing portions of the mount frame members 13 and 14 are disposed in their cut portions 15, so as to fix those integrally by means of welding or the similar manner. Therefore, the front and rear connecting members 11 and 12 are arranged on substantially the same level as the mount frame members 13 and 14, so as to form the aseismatic mount as thin as possible.

Figure 3:
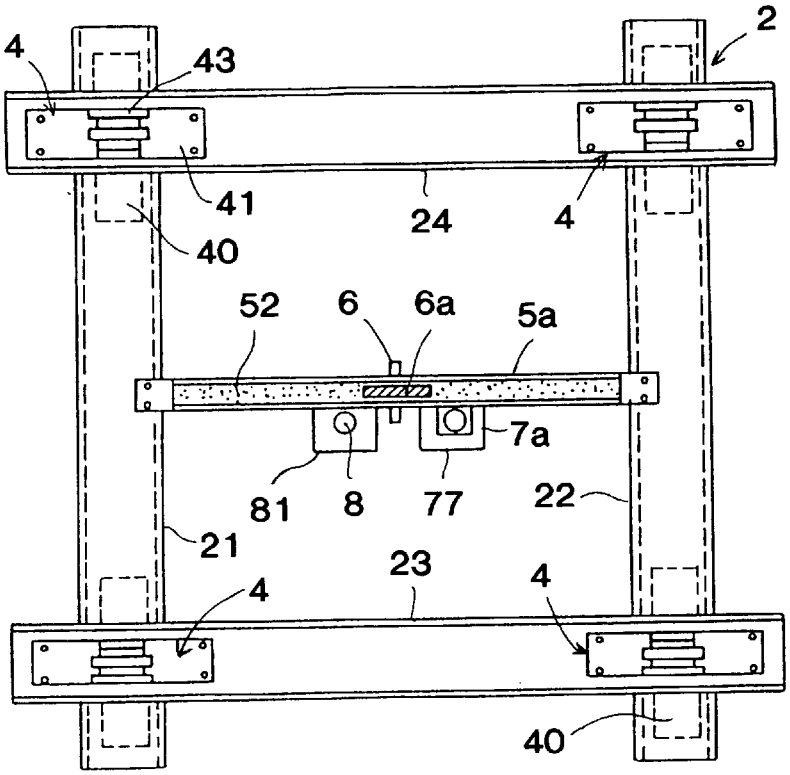
FIG. 3 is a plan view of a middle mount frame of the aseismatic mount.

As shown in FIG. 3, the middle mount frame 2 comprises the right and left aseismatic means mount frame members 21 and 22, which are positioned above the right and left mount frame members 13 and 14 of the lower mount frame 1 to face each other and made of longitudinal rectangular steel channel members of parallel arrangement, and the right and left aseismatic means mount frame members 23 and 24, which are formed laterally rectangular and crossed and fixed to the mount frame members 21 and 22 at a right angle. The right and left mount frame members 13 and 14 of the lower mount frame 1 are formed in a letter of u in section, facing upwards, and on the other hand, the right and left mount frame members 21 and 22 of the middle mount frame 2 are formed in a letter of u in section, facing downwards. Therefore, the mount frame members 13 and 21, which are faced parallelly to each other in up and down directions, and the mount frame members 14 and 22, face the opening sides of their grooves of each other, as shown in FIG. 1.

Figure 4:
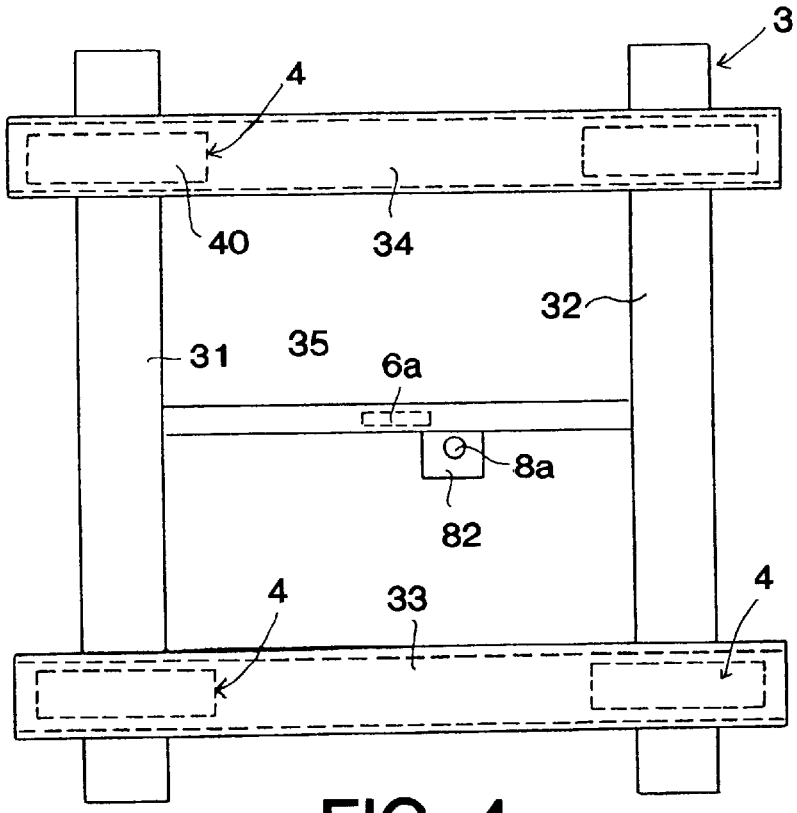
FIG. 4 is a plan view of an upper mount frame of the aseismatic mount.

As shown in FIG. 4, the upper mount frame 3 is constructed such that right and left aseismatic means mount frame members 31 and 32, which are formed longitudinally rectangular, and right and left aseismatic means mount frame members 33 and 34, which are face toward each other and made of laterally rectangular steel channel members, are assembled in parallel crosses and fixed integrally. These front and rear mount frames 33 and 34, and the right and left connecting members 31 and 32, are assembled in parallel crosses at right angle, in the same manner as the lower mount frame 1, but the connecting members 31 and 32 at their crossing portions, are cut with just the width of each of the mount frame members 33 and 34, and the crossing portions of the mount frame members 33 and 34 are disposed in their cutting portion and fixed integrally by means of welding or the similar manner. The front and rear mount frames 33 and 34 are formed to be a letter of u in cross section, facing downwards, and the mount frame members 33 and 34, are arranged parallelly with the front and rear mount frame members 23 and 24 of the middle mount frame 2, frame members 23 and 24 are formed in a letter of u in cross section, facing upwards, so as to face each of the opening sides of the grooves of the channels.

Figure 5:
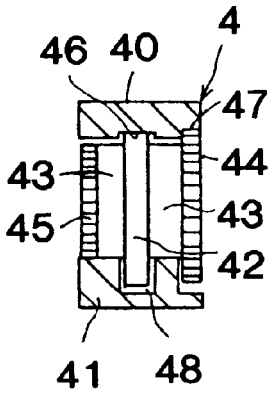
FIG. 5 is a sectional front view of aseismatic means.
Figure 6:
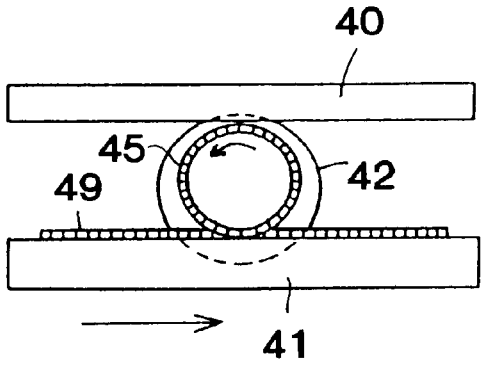
FIG. 6 is a left side view of the aseismatic means.
Figure 7:
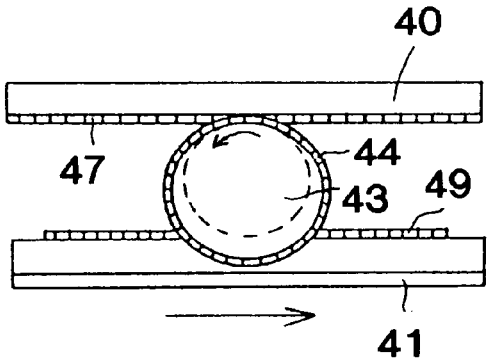
FIG. 7 is a right side view of the aseismatic means.

As shown in FIGS. 5 through 7, the aseismatic means 4 is so constructed that circular rollers 42 and 43 of large and small diameters and pinions 44 and 45 of large and small diameters are interposed between upper and lower guide members 40 and 41 having racks, the opposite faces of which are parallel to each other. In detail, a shallow groove 46 is formed with the undersurface of the upper guide member 40 at its center along a whole of the length and a rack gear 47 is provided integrally with the undersurface of an end of the side of the upper guide member 40. On the other hand, a deep groove 48 is formed with the upper surface of the lower guide member 41 at its center along a whole of the length and a rack gear 49 is provided integrally with the upper surface of the other end of the side of the upper guide member 40.

Further, each of the rollers 43 are provided integrally with both sides of the roller of large diameter 42, in such a state that the centers of the rollers 43 are eccentrically shifted upwardly with respect to the center of the roller of large diameter 42, and that the periphery of the roller of large diameter 42 projects from the peripheries of the rollers of small diameters 43. The rollers 43 are provided integrally with a pinion of large diameter 44, on an end thereof, which pinion has the same diameter as the roller 42 of large diameter and is positioned eccentricaly with respect to the rollers 43. The roller 43 on the other side is provided integrally with a pinion 45 having the same diameter as the roller 43 of small diameter. The center of the roller of large diameter 42 and the center of the pinion of large diameter 44 are on the same central rotation axes, and the centers of the rollers of small diameter 43 and the center of the pinion of small diameter 45 are also on the same central rotation axes. Each of the upper and lower guide members 40 and 41 has a width narrower than the width of the groove of the mount frame made of a steel channel member, but they are formed by rectangular plates which are shorter than the mount frame.

Furthermore, the rollers of small diameter 43 rolls on the upper surface of the lower guide member 41 without contacting with the upper guide member 40, and the roller of large diameter 42 rolls in such a state that it is always in contact with the bottom of the upper groove 46 without contacting the lower grove 48 while inserting the periphery of the roller 42 into the grooves 46 and 48 of the upper and lower guide members 40 and 41. On the other hand, the pinion 45 of small diameter roller 45 rolls in engagement with the rack gear 49 of the lower guide member 41 without contacting the upper guide member 40, and the pinion of large diameter 44 rolls integrally with the rollers of large and small diameters 42 and 43 and the pinion of small diameter 45, while engaging with the rack gear 47 of the upper guide member 40, without contacting the lower guide member 41. Therefore, when the rollers of small diameter 43 roll on the lower guide member 41, the roller of large diameter 42 rolls integrally therewith, and the upper guide member 40 mounted on the roller of large diameter 42, moves in the longitudinal direction thereof. The pinions of large and small diameters 44 and 45 provided integrally with those rollers of large and small diameters 42 and 43, rotate integrally with the rollers of large and small diameters 42 and 43, while engaging with the rack gears 47 and 49, so as to prevent the rollers of large and small diameters 42 and 43 from slipping with respect to the upper and lower guide members 40 and 41.

The aseismatic means 4, as constructed above, is disposed in the front and rear portion in the opposite grooves of the right and left mount frame members 13 and 14 where the groove of the lower mount frame 1 is opened upwardly, and the right and left mount frame members 21 and 22 where the groove of the middle mount frame 2 is opened downwardly. In other words, the aseimatic means 4 is interposed between the mount frame members 13 and 21, and the mount frames 14 and 22, facing in up and down directions, in such a state that the upper and lower guide members 41 are directed longitudinally of the mount frame member. At the time, the lower guide member 41 of the aseismatic means 4 is set in the grooves of the mount frame members 13 and 14 of the lower mount frame 1, and the undersurface of the means is fixed to the bottom surface of the grooves by means of bolts, and also the upper guide member 40 is set in the grooves of the mount frame members 21 and 22 of the middle mount frame 2 and the upper surface of the means is fixed to the bottom surfaces of the grooves by means of bolts.

Similarly, the aseismatic means 4 is disposed in both side portions in the opposite grooves of the front and rear mount frame members 23 and 24 where the groove of the middle mount frame 2 is opened upwardly, and the front and rear mount frame members 33 and 34 where the groove of the upper mount frame 3 is opened downwardly. In other words, the aseimatic means 4 is interposed at the four corner portions between the upper mount frame 3 and the middle mount frame 2, and between the mount frame members 23 and 33 and the mount frame members 24 and 34, in such a state that the upper and lower guide members 41 are directed longitudinally of the mount frame member. At the time, the lower guide member 41 of the aseismatic means 4 is set in the grooves of the mount frame members 23 and 24 of the middle mount frame 2, and the tinder surface of the means is fixed to the bottom surface of the grooves by means of bolts, and also the upper guide member 40 is set in the grooves of the mount frame members 33 and 34 of the upper mount frame 3 and the upper surface of the means is fixed to the bottom surfaces of the grooves by means of bolts. Therefore, the aseismatic means 4 disposed in the four portions between the lower mount frame 1 and the middle mount frame 2, and the aseismatic means 4 disposed in the four portions between the middle mount frame 2 and the upper mount frame 3 are arranged in up and down directions to cross one another at right angle. Thus, the aseismatic mount A is so constructed that the middle mount frame 2 and the upper mount frame 3 are mounted on the lower mount frame in order, leaving a small clearance therebetween.

The numeral 5 is a groove member of U-letter in section, and the front and rear ends thereof are fixed to the opposite surfaces of the front and rear connecting members 11 and 12 of the lower mount frame 1. As shown in FIG. 2, the groove member 5 is arranged in parallel with the right and left mount frame members 13 and 14, and a viscous oil 51 is received in the groove. On the other hand, a resistant plate 6 is attached to the undersurface of the middle mount frame 2, to face the center portion of the groove member 5 in the longitudinal direction thereof, and the resistant plate 6 is dipped in the viscous oil 51 of the groove member 5. Similarly, a groove member 5*a* of U-letter shape in section is fixed provisionally between the right and left mount frame members 21 and 22 in parallel with the front and rear mount frame members 23 and 24, namely in a direction crossing the lower groove member 5, and a viscous oil 52 is received in the groove 5*a*. On the other hand, a crosspiece 35 is fixed between the right and left connecting members 31 and 32 of the upper mount frame 3, and a resistant plate 6*a* is attached to the undersurface of the crosspiece 35 to face the center portion of the groove member 5*a* in a longitudinal direction thereof, and then the resistant plate 6*a* is dipped in the viscous oil 52 of the groove member 5*a*. The groove members 5 and 5*a* receiving the viscous oils 51 and 52, and the resistant plates 6 and 6*a,* comprise a damper for absorbing a vibration or shake energy. The resistant plate 6 on the side of the middle mount frame is fixed to the undersurface of the upper groove member 5*a*. It is preferable to provide a cover for covering a groove member of U-letter in section with the middle mount frame 2 and the upper mount frame 3. Further, it may place the damper at an end of the mount frame, but may not place it at the center portion of the mount frame.

Figure 8:
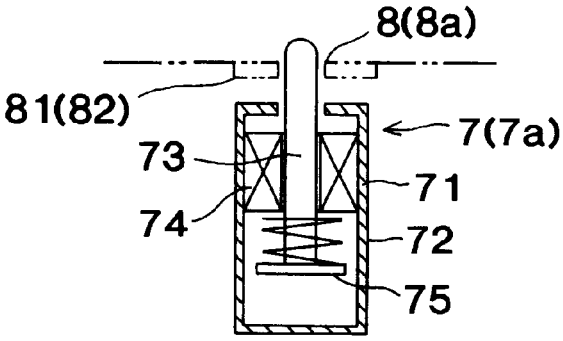
FIG. 8 is a schematic sectional view of a trigger.

The numeral 7 is a triger which is attached onto a base 76 fixed to a suitable portion of the groove member 5 which is fixed to the lower mount frame 1. As shown in FIG. 8, a red 73 is provided within a cylinder 71 to be always urged downwardly by means of a spring 72, and a solenoid 74 is also set in the cylinder 71. By conducting the solenoid 74, an iron piece 75, which is a movable iron of the solenoid 74 and fixed to a lower end of the rod 73, is drawn against the force of the spring 72, so as to make the upper end of the rod 73 project from the cylinder 71. Accordingly, the upper end of the rod 73 is drawn into the cylinder 71 by means of the force of the spring 72 at the time of non-conduction such as a stoppage of electric power. Similarly, a triger 7*a* having the same construction as the above, is provided on a base 77 which is fixed to the center portion of the groove member 5*a* which is fixed to the middle mount frame 2.

Further, plates 81 and 82 are faced toward each other above the trigers 7 and 7*a* and fixed to the center portion of the groove member 5 of the middle mount frame 2 and the center portion of the crosspiece 35 of the upper mount frame 3, which plates have engaging openings 8 and 8*a* through which the upper end of the rod 73 is inserted slidably. It is possible not to attach the trigers 7 and 7*a* to the center portion of the mount frame. The numeral 92 is a vibration detector which is attached to a suitable portion of the lower mount frame 1, and electrically connected to the trigers 7 and 7*a,* so that the rod 73 leaves from the engaging opening 8 and 8*a* by releasing excitation of the solenoid 74 of the trigers 7 and 7*a* at the time of an earthquake.

The aseismatic mount A as consructed above, provides caster wheels 90 on the undersurface of the four portions of the lower mount frame 1, respectively and an adjuster 91 at the four corners thereof, respectively. The aseismatic mount A is fixed at a level on the setting surface such as a floor while lifting the wheels 90 from the setting surface by regulating the hight of the adjusters 91.

Figure 9:
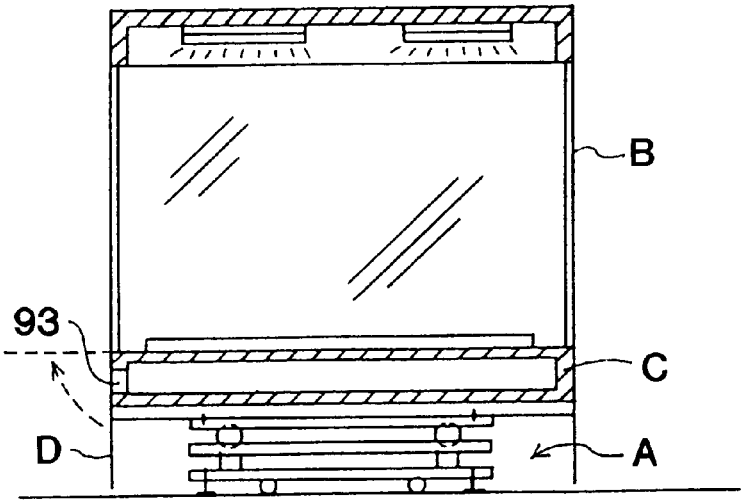
FIG. 9 is a brief sectional front view in the state that the showcase is mounted on the aseismatic mount.

Thus, the showcase is constructed by mounting a showcase B housing the exhibition articles on the aseismatic mount A. As shown in FIG. 9, it is preferable to interpose, between the aseismatic mount A and the showcase B, a middle mount C, which is thin and hollow having a lateral opening 93 into which a fork of a forklift truck may be inerted. The exhibition articles such as art works may be mounted directly on the middle mount C without using the showcase B, and in this case, the middle mount C may be used as an exhibition mount. In the same drawing, it shows that an area of the showcase B in plan view, is larger than that of the aseismatic mount A, and in this case it may detachably hang a screen D on the four sides of the middle mount C for covering and hiding the aseismatic mount A .

Figure 10:
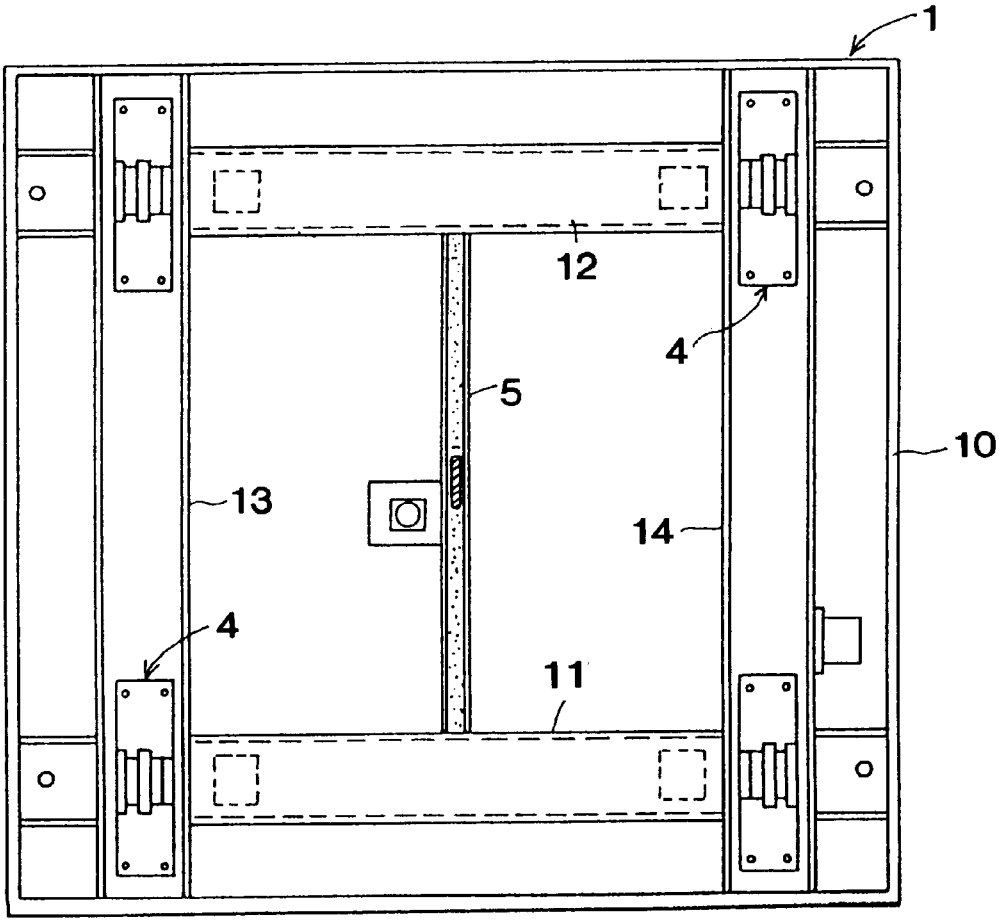
FIG. 10 is a plan view of the lower mount frame provided integrally with a rectangular outer frame.
Figure 11:
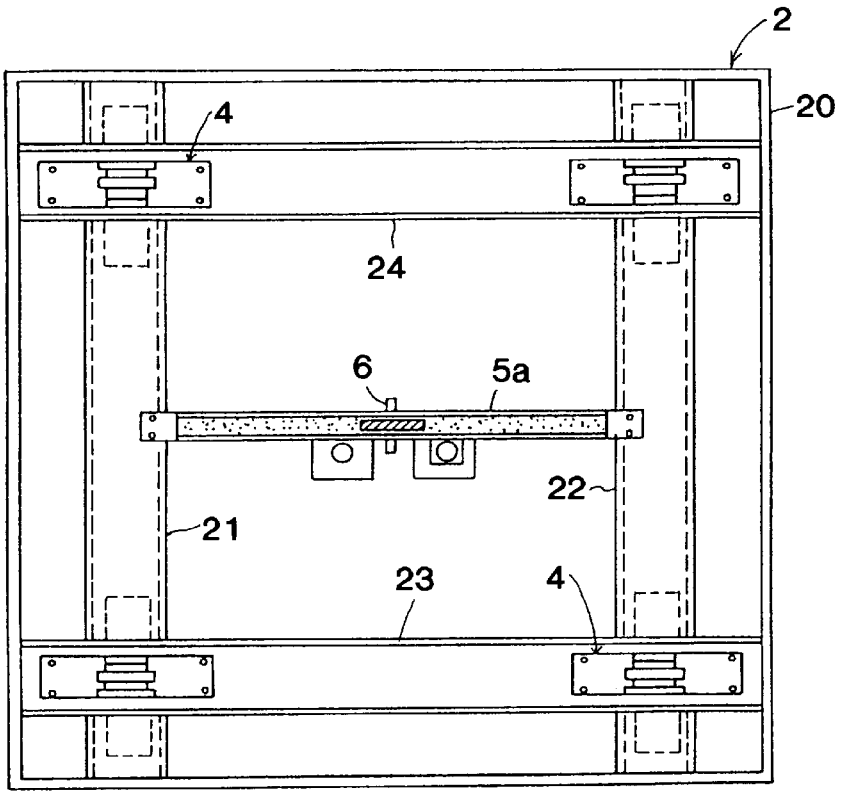
FIG. 11 is a plan view of the middle mount frame provided integrally with a rectangular outer frame.
Figure 12:
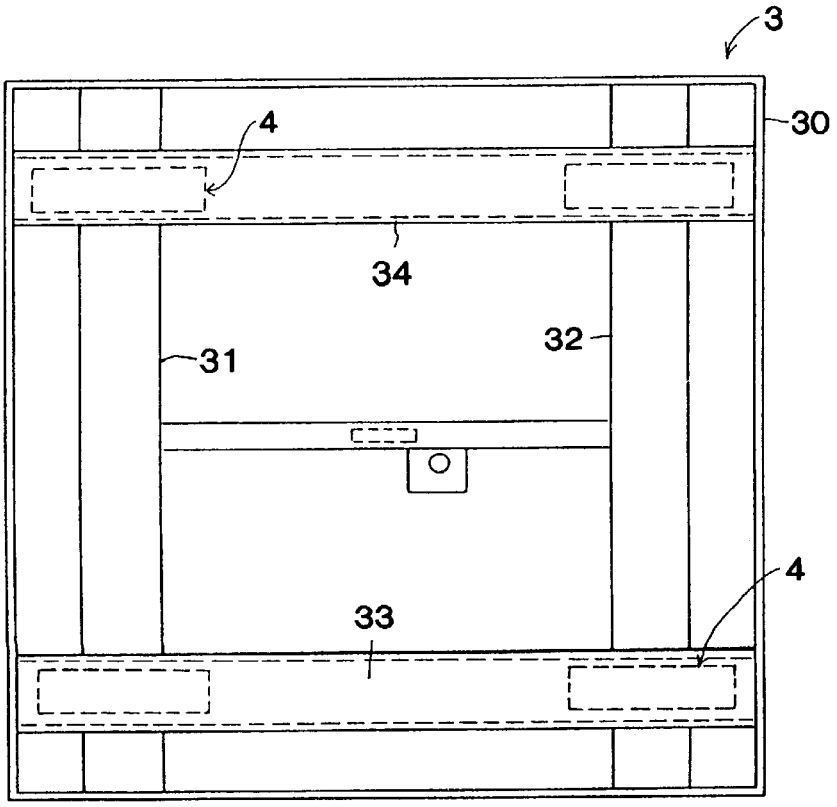
FIG. 12 is a plan view of the upper mount frame provided integrally with a rectangular outer frame.
Figure 13:
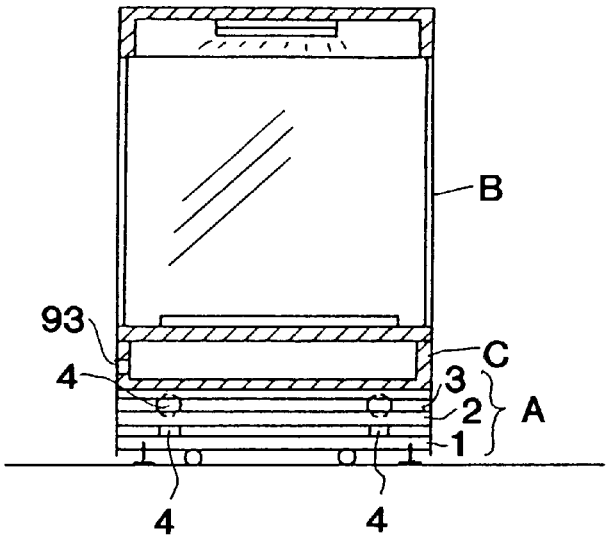
FIG. 13 is a brief sectional front view showing the showcase mounted on the series of aseismatic mounts having outer frames.
Figure 14:
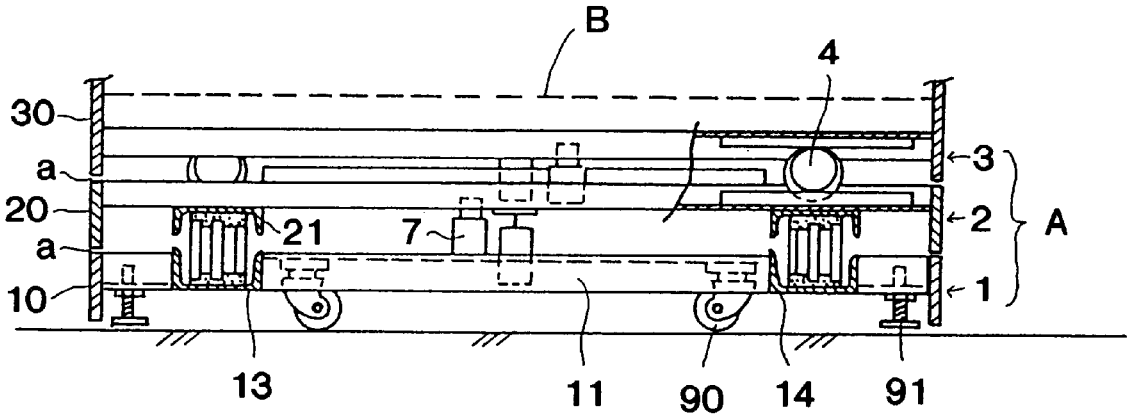
FIG. 14 is a partial sectional front view of the aseismatic mount.

As shown in FIGS. 10 through 12, it is possible to fix the showcase A and rectangular outer frames 10, 20 and 30, which are the same form in plan view, to the upper and lower mount frames 1 and 3 and the middle mount frame 2 of the aseismatic mount A in such a state that the showcase and the rectangular outer frames are on a vertical plan with respect to the showcase B and the middle mount C. As shown in FIGS. 13 and 14, in the state that the rectangular outer frames 10, 20 and 30 comprise the aseismatic mount A, a clearance a is formed between the outer frames opposite in up and down directions, in order to allow each of the mount frames 1 to 3 to move relatively in horizontal directions. These rectangular outer frames 10, 20 and 30 comprise a skirt of the showcase B, so as to hide the aseismatic means 4 in the aseismatic mount A.

To mount the showcase B on the aseismatic mount A, after the aseismatic mount A is first moved to the place of installation, hight and level adjustment is carried out by means of the adjuster 91, so as to lift the wheels 90 and fix the aseismatic mount on the surface of the place of the installation. Next, the showcase B is mounted on the middle mount C and fixed by means of bolts, and the fork of the forklift truck is inserted into the lateral openings 93 of the middle mount C and lifts it so as to adjust the position of the middle mount C on the aseismatic mount A, and then fix them by means of bolts. In advance, it is possible to mount the showcase B on the aseismatic mount A via the middle mount C and to move them to the place of installation and then fix them on the place by means of the adjuster 91. It may set the exhibition articles in the showcase B in advance, or set the exhibition articles in the showcase B after mount of the showcase on the aseismatic mount A. Further, these manners may be adopted for the case that the middle mount C is used as the mount for exhibition articles without using the showcase B.

Each of the aseismatic means 4 arranged on the aseismatic mount A, provides the upper and lower guide members 40 and 41 which are disposed in the grooves of the mount frames made of steel channel members of the base frame which are faced toward each other. Therefore, the thickness of the whole of the aseismatic mount can be thin. In the normal state, due to the load of the showcase, the roller 42 of large diameter, which is integral with the roller 43 of small diameter and interposed between the upper and lower guide members 40 and 41, takes such a state that the roller 42 places its center just beneath the center of the roller of small diameter and faces upwardly from its peripheral portion which is shortest from the center of the roller of small diameter, or the peripheral portion thereof which is least in the amount of projection from the periphery of the roller of small diameter. Thereby, the aseismatic means 4 is able to support the load of the showcase B stably.

In the normal state at the time of exhibition, each of the solenoids 74 of the trigers 7 and 7*a* which are attached to the lower mount frame 1 and the middle mount frame 2 of the aseismatic mount A, is actuated, and the rod 73 is made to project upwardly against the force of the spring 72 and inserted into each of the engaging openings 8 and 8*a* of the plates 81 and 82 attached to the middle mount frame 2 and the upper mount frame 3, and then engaged. As the result, the middle mount frame 2 and the upper mount frame 3 become in the state that they are not movable in horizontal directions, regardless of existence of the rollers 42 and 43 of large and small diameters, so that free movement of the showcase B may be prevented when the showcase is pushed unexpectedly.

Where maintenace or inspection of the aseismatic means 4 is carried out, after releasing fixation of the upper mount frame 3 and the middle mount C, the exhibition articles and the showcase B housing the exhibition articles are lifted together with the middle mount C by means of the forklift truck to move them away from the aseismatic mount A. It is possible to carry out inspection of the interior of the aseismatic menans 4 in such a state that after releasing fixation of the upper and lower mount frames by means of the trigers 7 and 7*a,* the middle mount frame 2 and the upper mount frame 3 are moved horizontally via the rollers of large and small diameters 42 and 43.

Next, when an earthquake happens, the vibration detector 92 detects and electric conduction to the trigers 7 and 7*a* is cut. The trigers 7 and 7*a* are demagnetized by cutting conduction, the rod 73 goes into the cylinder 71 by means of the force of the spring 72, so as to disengage with the engaging openings 8 and 8*a,* and the middle mount frame 2 becomes to be movable with respect to the lower mount frame 1 in a direction in which the upper mount frame 3 crosses the middle mount frame 2 at right angle, via the roller of large and small diameters 42 and 43. Where a rope is tied so that inspectors cannot approach the showcase B, it is possible to take such a construction that it provides a pin for fixing the mount frames facing in up and down direction togethher, and an engaging opening member for engaging and disengaging the pin without providing the vibration detector 92 or the trigers 7 and 7*a.* The pin engages with the engaging opening member only at the time of setting the aseismatic mount A or mounting the showcase B on the aseismatic mount A, and after setting them its engagement may be released.

When the lower mount frame 1 vibrates or shakes reciprocally in a wave direction together with the installation base at the time of an earthquake, the rollers of large and small diameters 42 and 43 of the aseismatic means 4, which is arranged to be rolled in the directions of vibration, rolls relatively with respect to the lower mount frame 1 in an opposite direction. For example, in FIGS. 5 through 7, when the lower guide member 41 integral with the lower mount frame 1, moves in a direction of an arrow, the roller of small diamger 43 tightly contacting the lower guide member 41, is given a rotation force in a direction of counterclockwise, and the eccentric roller of large diameter 42 rolls integrally in the same direction, so that the upper guide member 40 mounted on the roller of large diameter 42 tends to move relatively in an opposite direction with respect to the lower guide member 41.

When the roller of large diamter 42 rolls as mentioned above, as its turning angle increases, since the amount of projection of the periphery of the roller of large diameter 42 from the periphery of the roller of small diameter 43, becomes great, and the center of the roller of large diameter 42 moves in an opposite direction with resepct to the center of the roller of small diameter 43, a resistant force occurs to prevent its rolling due to the load of the showcase B, and then the rollers of large and small diameters 42 and 43 stop rolling due to the force of resistance. From the situation, the upper guide member 40 supporting the exhibition articles, moves laterally in the same direction of the lower guide member 41 with a time lag.

Further, in the lateral movement of the upper guide member 40, the lower mount frame 1 moves in an opposite direction due to the reciprocal vibrations of the earthquake, and the rollers of large and small-diameters 42 and 43 roll in an opposite direction according to the lateral movement so as to generate a resistant force in the opposite direction. Therefore, the upper guide member 40 tends to move laterally in the same direction as the lower guide member 42 after the upper guide member is moved for a very small distance in comparison with the lateral movement of the lower mount frame 1. Accordingly, the amount of lateral movement of the upper guide member 40 due to the earthquake becomes little, and as the result the exhibition articles mounted on the upper mount frame 3 via the upper guide member 40, becomes minimum. Swing of the lower guide member 40 is not transmitted to the upper guide member 42 when the lower guide member 40 swings right and left, and the rollers of large and small diameters 42 and 43 rotate right and left directions about an axis which is a contact point where the rollers of large and small diameters contact with the lower guide member 42. Namely, the lateral vibrations or shakes are reduced via the rollers of large and small diameters 42 and 43 and transmitted to the exhibition articles, so that swing of the exhibition articles can be controlled.

The aseismatic means 4 interposed between the lower mount frame 1 and the middle mount frame 2, and the aseismatic means 4 interposed between the middle mount frame 2 and the upper mount frame 3, are arranged to cross each other. Therefore, any directions of vibration or shake including front and rear, and right and left directions are not transmitted to the exhibition articles or the showcase B, mounted on the upper mount frame 3, due to existance of the upper and lower aseismatic means 4. Further, each of the pinions of large and small diameters 44 and 45 integral with the rollers of large and small diameters 42 and 43, engages with each of the rack gears 47 and 49, which are provided with the upper and lower guide members 40 and 41, and then rolls together with the rollers of large and small diameters 42 and 43, so as to prevent the rollers of large and small diameters 42 and 43 from slipping with respect to the upper and lower guide members 40 and 41. As the result, the rollers of large and small diameters 42 and 43 of all of the aseismatic means 4 can be rotated with the same rotation speed.

The resistant plates 6 and 6*a,* which project from the middle mount frame 2 and the upper mount frame 3, are dipped in the viscous oils 51 and 52 in the grooves 5 arranged in parallel with the directions of movement of the lower mount frame 1 and the middle mount frame 2. Therefore, each of the lateral movements of the middle mount frame 2 and the upper mount frame 3, is absorbed and reduced by means of the viscous oils 51 and 52, and after the earthquake, the middle mount frame 2 and the upper mount frame 3, which mount the exhibition articles or showcase B, can be returned to their original positions quickly and surely.

The amount of displacement in horizontal directions necessary for recovering vibrations or shakes at the time of a big earthquake, is, at most, 30 cm~40 cm. Therefore, the diameter of each of the rollers of large and small diameters 42 and 43 is determined so that it becomes possible to allow at least the amount of displacement between the upper and lower mount frames. In this case, the turnning angle of the roller of large diameter 42 should be determined less than 180 degrees in order to generate the above-mentioned resistant force. Therefore, when the rollers of large and small diameters 42 and 43 turn a half rotation, the amount of relative displacement in horizontal directions between the upper and lower mount frames, becomes the sum of circumference of the half circle of each of the rollers 42 and 43, and so the diameters of the rollers of large and small diameters 42 and 43 can be easily determined for recovering the amount of maximum displacement.

Figure 15:
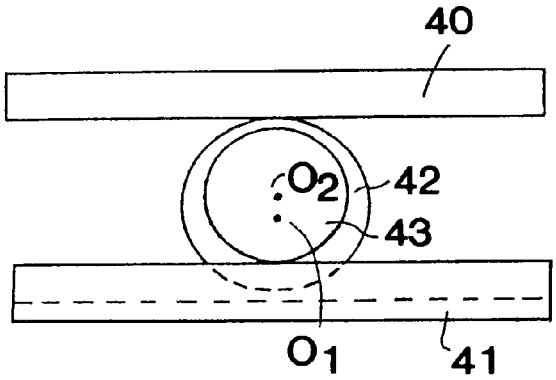
FIG. 15 is a schematic side view of a modified aseismatic means.
Figure 16:
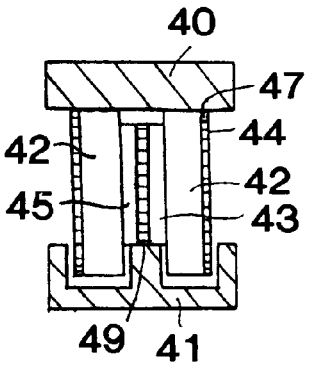
FIG. 16 is a sectional side view of the aseismatic means modified.

In the embodiment as mentioned above, as the aseismatice means, the roller of large diameter 42 is provided integrally with the rollers of small diameters 43 on the both sides thereof, in such a state that the centers of the rollers of small diameters are eccentrically shifted upwards with respect to the center of the roller of large diameter. However, as shown in FIGS. 15 and 16, it is possible to adopt such a construction that the roller of small diameter 43 is provided integrally with the rollers of large diameters 42 on the both sides thereof, in such a state that the center $O_1$ of each of the rollers of large diameters 42 is eccentrically shifted downwards with respect to the center $O_2$ of the roller of small diameter 43. In this case, the roller of large diamter 42 rotatably contacts with the undersurface of the upper guide member 40, and the pinion of large diameter 44, which has the same diameter as the roller of large diameter 42 and is arranged on the same center line with the roller of large diameter, engages with the rack gear 47, provided with the undersurface of the upper guide member 40. On the other hand, the roller of small diameter 43 rotatably contacts with the upper surface of the lower guide member 41 and the pinion of small diameter 45, engages with the rack gear 49, provided on the upper surface of the lower guide member 41, said pinion having the same diameter as the roller of small diameter 43 and arranged on the same center line with the roller of small diameter.

Figure 17:
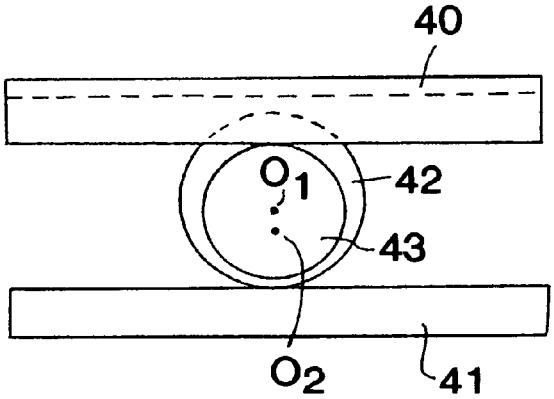
FIG. 17 is a schematic side view of another embodiment of the aseismatic means.
Figure 18:
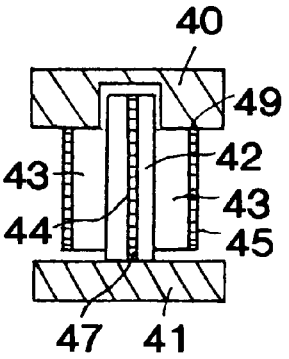
FIG. 18 is a sectional side view of the embodiment of the aseismatic means, shown in FIG. 17.
Figure 19:
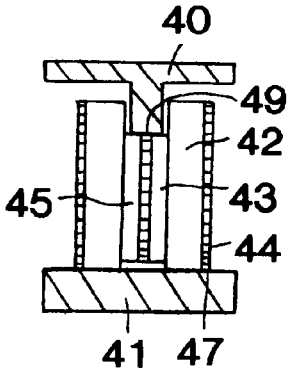
FIG. 19 is a sectional side view in the case that a roller of large diameter is provided integrally on both sides of a central roller of small diameter.

As the aseismatic means, the following construction may be adopted except the above mentioned constructions. Namely, FIGS. 17 and 18 show the aseismatic means that the center $O_2$ of the roller of small diameter 43 is eccentrically shifted downwards with respect to the center $O_1$ of the roller of large diameter 42. In this case, it is possible to use the construction that the roller of large diamter 42 is provided with the rollers of small diameters 43 on the both sides thereof, as shown in FIG. 18, or that the roller of small diameter 43 is provided integrally with the rollers of large diameters 42 on the both sides thereof. In either case, the roller of small diameter 43 the center of which is eccentrically shifted downwards, rotatably contacts with the undersurface of the upper guide member 40, and the pinion of small diameter 45, which has the same diameter as the roller of small diameter 43 and is arranged on the same center line with the roller of small diameter, engages with the rack gear 47, provided with the undersurface of the upper guide member 41. On the other hand, the roller of large diameter 42, the center $O_1$ of which is eccentrically shifted upwards, rotatably contacts with the upper surface of the lower guide member 40 and the pinion of large diameter 44, engages with the rack gear 49, provided on the upper surface of the lower guide member 44, said pinion having the same diameter as the roller of large diameter 42 and arranged on the same center line with the roller of large diameter.

Figure 20:
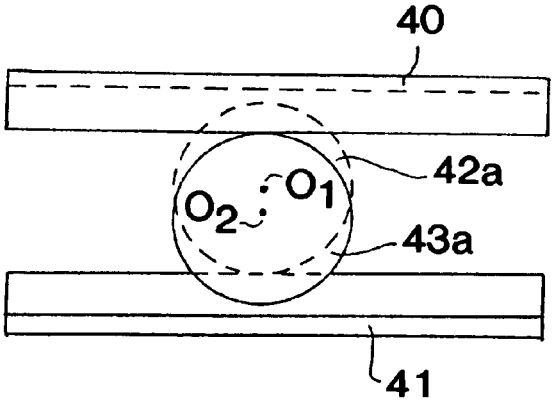
FIG. 20 is a schematic side view of another embodiment of the aseismatic means.
Figure 21:
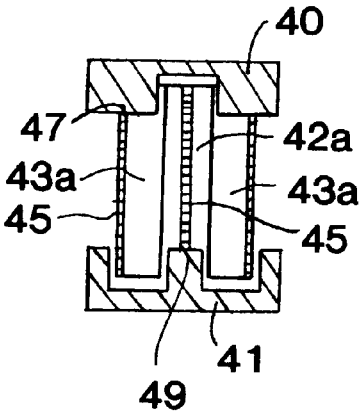
FIG. 21 is a sectional side view of the aseismatic means, shown in FIG. 20.
Figure 22:
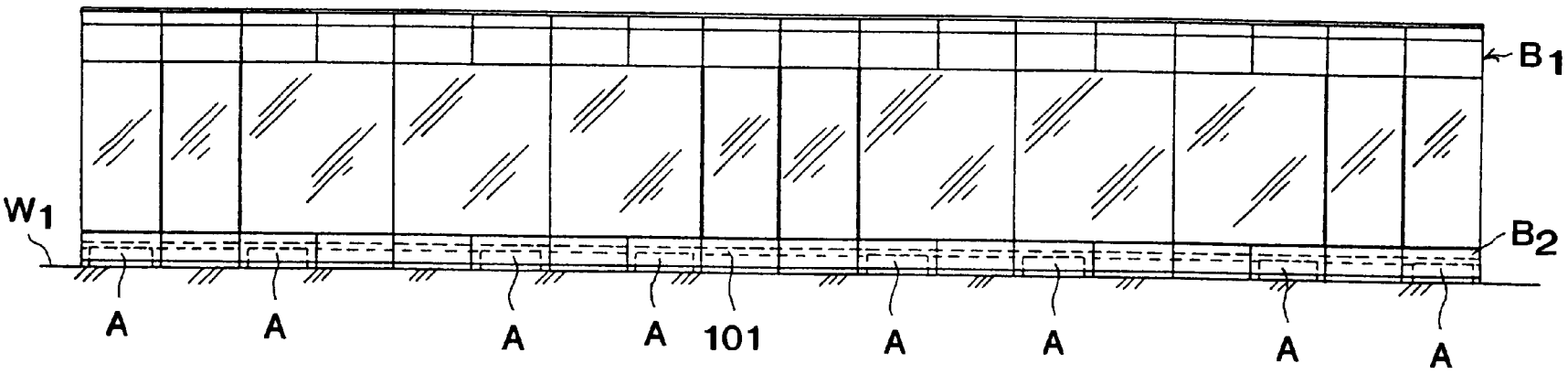
FIG. 22 is a partial front view of a long showcase fixed to the wall.
Figure 23:
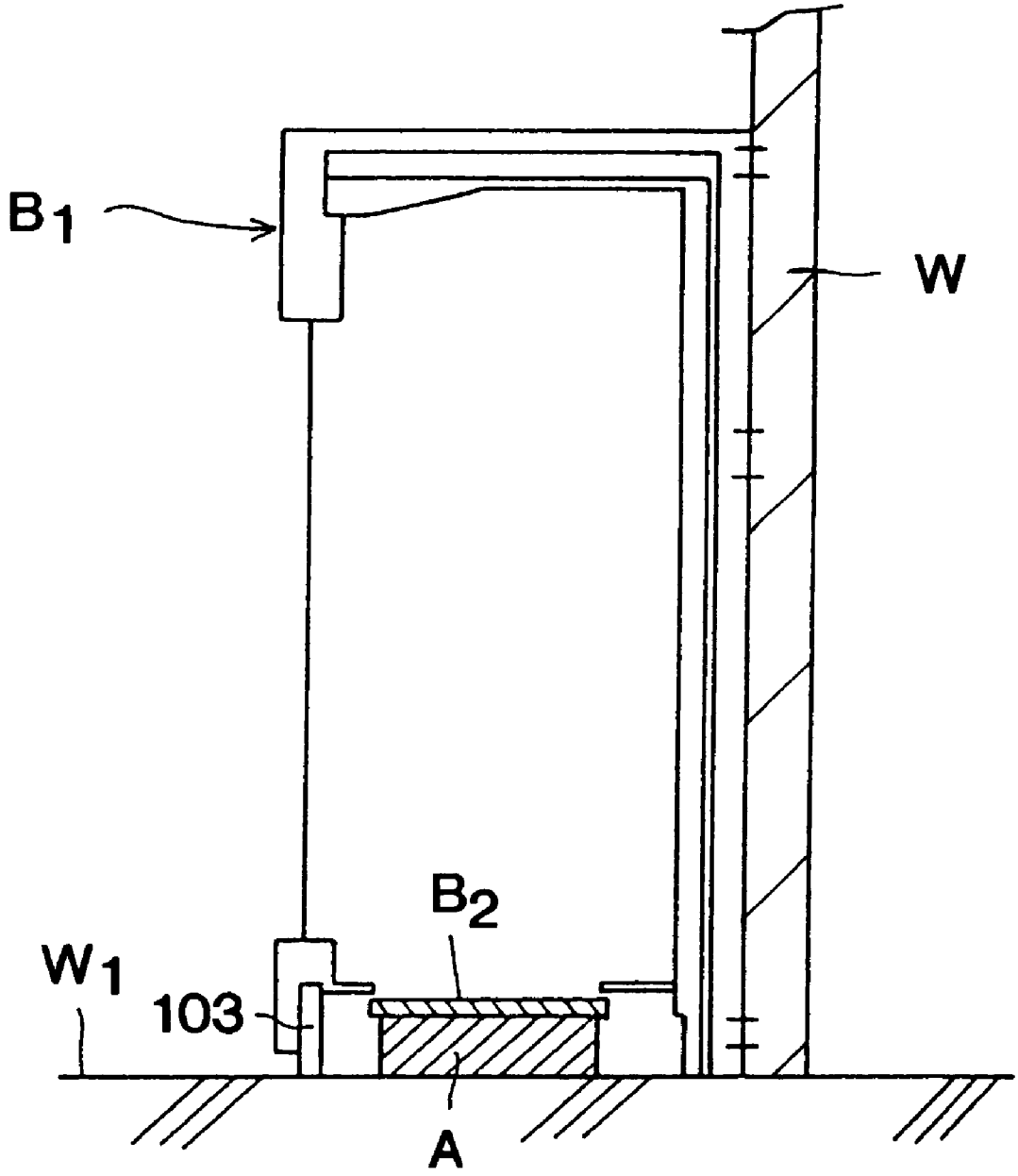
FIG. 23 is an enlarged sectional side view of the long showcase of FIG. 22.
Figure 24:
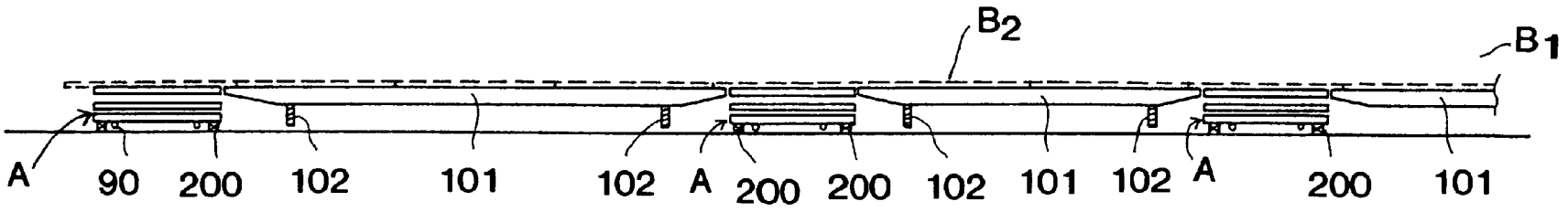
FIG. 24 is a fragmentary front view of the aseismatic mount of FIG. 22 supporting a mount plate for mounting exhibition articles.
Figure 25:
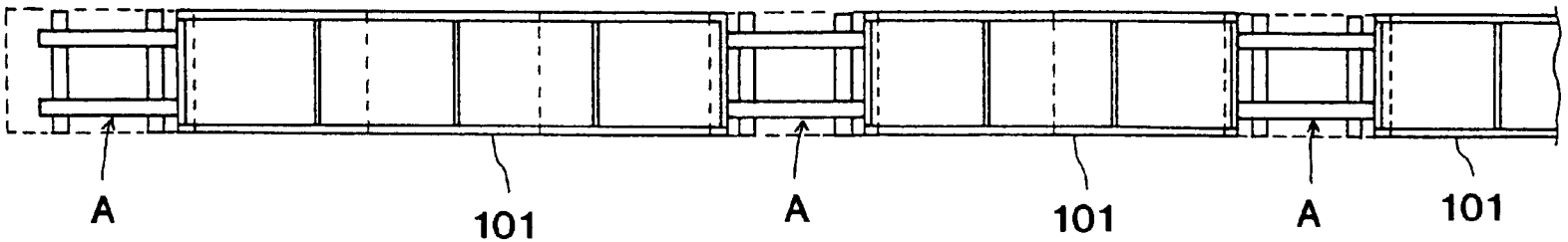
FIG. 25 is a schematic plan view of the aseismatic mount.

As the aseismatic means, as shown in FIGS. 20 and 21, it is possible to adopt such a construction that the rollers of same diameter 42*a* and 43*a* are formed integrally and eccentrically to shift their centers $O_1$ and $O_2$ up and down, without using the eccentric rollers of large and small diameters 42 and 43 which are mentioned above. The roller 43*a* the center $O_2$ of which is eccentrically shifted downwards, rotatably contacts with the undersurface of the upper guide member 40, and the pinion of small diameter 45, which has the same diameter as the roller 43*a* and is arranged on the same center line therewith, engages with the rack gear 47 provided with the undersurface of the upper guide member 41. On the other hand, the other roller 42*a* the center $O_2$ of which is eccentrically shifted upwards, rotatably contacts with the upper surface of the lower guide member 40, and the pinion of large diameter 44, which has the same diameter as the roller 42*a* and is arranged on the same center line therewith, engages with the rack gear 49 provided with the upper surface of the lower guide member 40. Thereby, it becomes possible to obtain the above-mentioned fuction of controlling vibration and shake. In any case, as the aseismatic means, the roller the center $O_2$ of which is lower, rotatably contacts with the undersurface of the upper guide member 41, and the other roller the center $O_1$ of which is higher, rotatably contacts with the upper surface of the lower guide member 42.

Next, FIGS. 22 through 25 show such a construction that a showcase which is long laterally, is supported by the above mentioned aseismatic mount A. The showcase comprises a main body $B_1$ of the showcase which is wide in lateral directions along the wall surface of the vertical wall W of the structure, and a base plate $B_2$ for mounting exhibition articles which is separated from the main body $B_1$ and arranged beneath the opening of the main body $B_1$ to function as the bottom plate of the main body $B_1$. A plurality of the aseismatic mounts A are arranged between a floor $W_1$ of the structure for installing the showcase, and the base plate $B_2$ for mounting exhibition articles, leaving a constant distance therebetween along the longitudinal directions of the base plate $B_2$ and then received on the upper surface of the upper mount frame 3 of each of the aseismatic mounts A. Between the aseismatic mounts A and A, a supporting beam 101 is provided with a stand member 102, is arranged in such a state that the end portion of the stand member is detachably connected to the end of the aseismatic mount A.

The main body $B_1$ of the showcase is fixed with its reverse side to the wall surface along the wall W of the structure. It is possible to give a good appearance to the showcase by covering the clearance between the floor $W_1$ and the base plate $B_2$ for mounting the exhibition articles to hide the aseismatic means and the like, by means of a screen plate 103 suspending from the front lower end of the main body $B_1$ of the showcase or detachably attached to the lower end of the main body $B_1$. The base plate $B_2$ for mounting exhibition articles has a certain width in front and rear directions, and provides a flat belt plate which is long in the direction of width of the main body $B_1$ of the showcase and has flexibility. This base plate $B_2$ is arranged to be relatively movable with respect to the main body $B_1$ of the showcase slight below the end of opening of the main body $B_1$.

Figure 26:
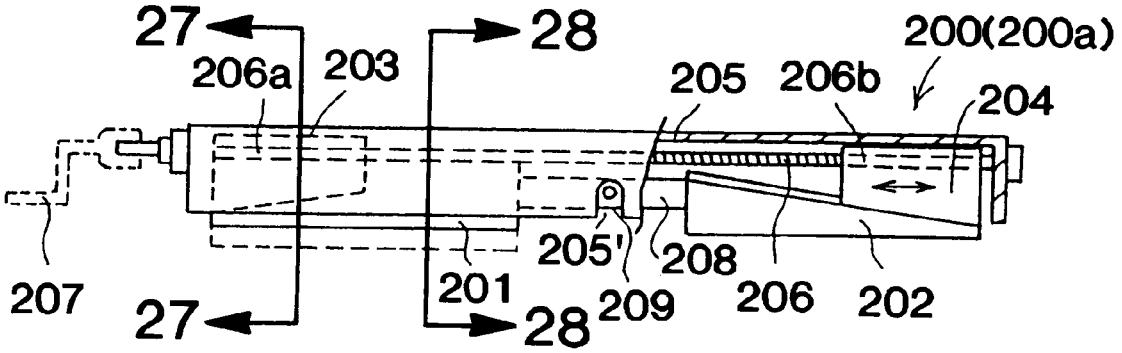
FIG. 26 is a partial side view of a lifting mechanism.
Figure 27:
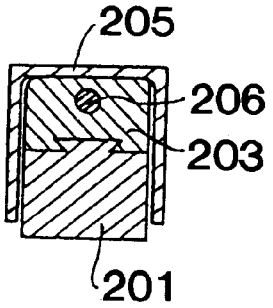
FIG. 27 is a sectional front view taken along lines I—I of FIG. 26.
Figure 28:
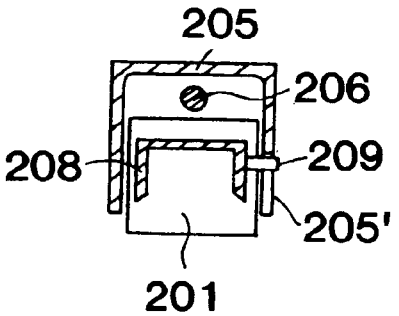
FIG. 28 is a sectional front view taken along lines II—II of FIG. 26.

A lift mechanism 200, comprising a jack, is arranged on the both sides of the undersurface of the aseismatic mount A, instead of the above-mentioned adjuster 91. As shown in FIGS. 26 through 28, the lift mechanism 200 comprises front and rear fixed and inclined bases 201 and 202, each having an inclined surface inclining the upper surface downwards from the opposite end surfaces thereof toward the front and rear directions thereof, front and rear wedge members 203 and 204, each being slidably engaged with the undersurface of the inclined surface on the fixed and inclined bases 201 and 202, a horizontal cover 205, formed in a letter of u in section, facing downwards, and mounted between the upper surfaces of the wedge members 203 and 204, a screw rod 206 supported by and rotatably inserted into the front and rear wall of the horizontal cover 205 with both ends of the rod, said screw rod having a front half screw rod portion 206*a* in the left direction which portion is inserted into a screw hole of left direction formed with the center portion of each of the front and rear wedge members 203 and 204 to penetrate them in the front and rear directions, and said screw rod also having a rear half screw rod portion 206*b* in the right direction which portion is inserted into a screw hole of right direction formed with the center portion of each of the front and rear wedge members 203 and 204 to penetrate them in the front and rear directions, and a handle 207 for rotating the screw rod, disengagable with the screw rod 206 projecting from the front wall of the horizontal cover 205. The front and rear fixed and inclined bases 201 and 202 are integrally connected to each other by means of a connecting member 208. A pin 209 projecting from the side of a connecting base 208, is inserted into a long hole 205' which is long in up and down directions and formed to cut the side wall of the cover 205.

The lift mechanism 200 as constructed above, may be attached integrally to the both sides of the undersurface of the lower mount frame 1 of the aseismatic mount A, or constructed independently of the aseismatic mount A, so as to contact with the floor $W_1$ and detachably insert into the lower space of the both sides of the lower mount frame 1.

Figure 29:
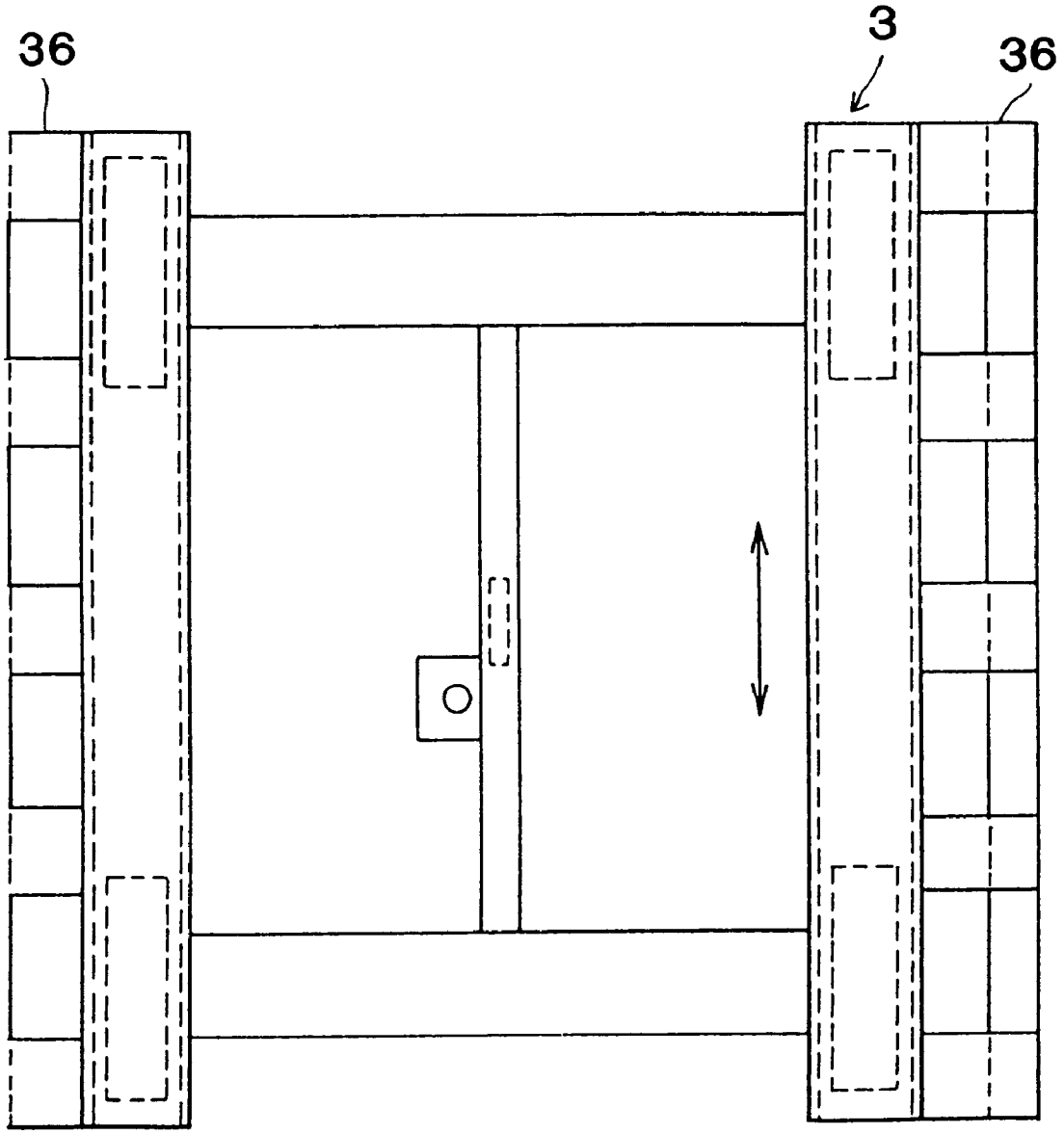
FIG. 29 is a plan view of the upper mount frame projecting a connecting member at both ends thereof.
Figure 30:
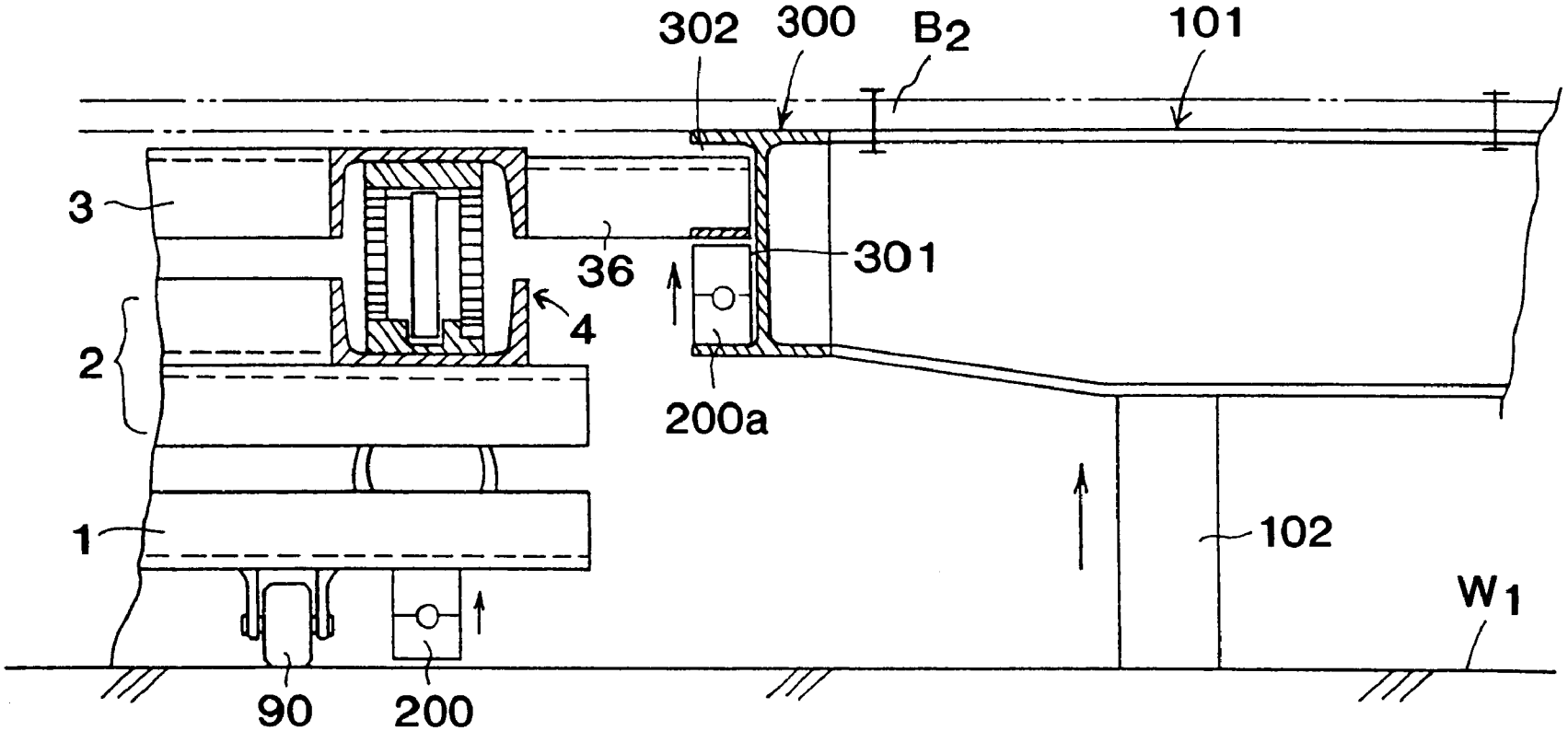
FIG. 30 is an enlarged sectional front view of the connecting portion between the connecting member of the aseismatic mount and a supporting beam.

As shown in FIG. 29, both sides of the upper mount frame 3 of the aseismatic mount A, projects a connecting member 36 which is long in front and rear directions and made of steel plate having a constant thickness. The aseismatic mount A is interposed between the base plate $B_2$ for mounting exhibition articles and the floor $W_1$. A plurality of the aseismatic mount A are arranged in the longitudinal directions of the base plate $B_2$, namely the directions of width of the wall W, leaving a predetermined distance therebetween, in such a state that the connecting members 36 projecting from both sides of the upper mount frame 3 are directed to right and left directions. A supporting beam 101 is interposed between the aseismatic mount A and A which are adjacent to each other. The upper surface of the supporting beam 101 is fixed integrally to the undersurface of the base plate $B_2$ for mounting exhibition articles by means of fixing means such as screws. Further, as shown in FIG. 30, fixing means 300 is provided integrally with the side wall of each of the supporting beams 101 facing the aseismatic mount A . The fixing means detachably fixes the connecting member 36 which projects from the upper mount frame 3 of the aseismatic mount A.

The fixing means 300 comprises a lateral groove member 301 which is made of an I-beam having substantially the same length as the connecting member 36, and has a groove 302 which is opened laterally, and a lift mechanism 200*a* having the same construction as the above-mentioned lift mechanism 200, is fixed to the groove bottom of the lateral groove member 301. Between the lift mechanism 200*a* and the undersurface of the upper wall of the lateral groove member 301, the above-mentioned connecting member 302 is interposed. It is possible to mount the lift mechanism 200*a* on the connecting member 36 and insert the lift mechanism into the groove 302.

When the aseismatic mount A is not arranged between the base plate $B_2$ and the floor $W_1$, for the reason of inspection or exchange, the base plate $B_2$ for mounting exhibition articles, which is separated from the main body of the showcase $B_1$ fixed to the wall W, is maintained horizontally by the supporting beam 101, as the stand member 102 fixed to the undersurface of the supporting beam 101, contacts with the floor $W_1$, so that the exhibition articles such as art works on the base plate $B_2$ for mounting exhibition articles may be supported stably.

Next, when interposing the aseismatic mount A between the supporting beams 101 and supporting the base plate $B_2$ for mounting exhibition articles by the aseismatic mount, the screw rod 206 of the lift mechanism 200 arranged on the both sides of the undersurface of the aseismatic mount A, is rotated by means of the handle 207, so as to move the wedge members 203 and 204 on the front and rear fixed and inclined bases 201 and 202 beneath the inclined end portion of the fixed and inclined bases 201 and 202, so that the height of the cover 205 is made lower than the undersurface of the lower mount frame 1. Then, the aseismatic mount A is inserted, from the front side, into the clearance between the undersurface of the base plate $B_2$ for mounting exhibition articles and the floor $W_1$, while the caster wheel 90 rolls on the floor $W_1$. The connecting members 36 which project from the end portions of both sides of the upper mount frame 3 of the aseismatic mount A, are inserted into the upper half portion of the groove 302 in the lateral groove member 301 of the supporting beams 101 and 101, which are adjacent to the connecting members.

Thereafter, the handle 207 of the lift mechanism 200 is operated to rotate in an opposite direction against the above mentioned rotation, the wedge members 203 and 204 move slidably towards the inlined upper end portion on the fixed and include bases 201 and 202 which are positioned on the floor $W_1$, so that the cover 205 moves upwards and the aseismatic mount A is lifted upwards and that the wheel 90 is lifted from the floor $W_1$. Then, the upper surfaces of the connecting members 36 of the aseismatic mount A tightly contact with the undersurface of the upper wall of the groove 302 of the lateral groove 301 of the supporting beams 101 and thereafter the supporting beams 101 are lifted and the stand member 102 is remote away upwardly from the floor $W_1$.

In this state, the upper surface of the upper mount frame 3 of the aseismatic mount A contacts with the under surface of the base plate $B_2$ for mounting exhibition articles. Where the clearance is formed between the upper surface of the upper mount frame 3 and the undersurface of the base plate $B_2$ for mounting exhibition articles, a flexible plate deformable under pressure is adhered to the upper surface of the upper mount frame 3 and as soon as the stand member 102 is remote away from the floor $W_1$, it may let the flexible plate contact with the undersurface of the base plate $B_2$ for mounting exhibition articles, simultenously.

The aseismatic mount A is lifted by means of the lift mechanisms 200 in such a manner as mentioned above, and the base plate $B_2$ for mounting exhibition articles are supported on the floor $W_1$ by means of the lift mechanisms 200 of all of the aseimatic mounts A. Further, the lift mechanism 220*a,* which is attached to the lower portion of the groove 302 of the lateral groove member 301 of the supporting beams 101 is operated by the handle so as to lift the cover 205 for catching the supporting beams 101 by the cover 205 and the undersurface of the upper wall of the lateral groove member 301, so that the aseismatic mont A and the supporting beams 101 may be strongly connected to each other and integrated.

Thus, the aseismatic mount A and the supporting beams 101 are connected to each other in right and left directions, and the base plate $B_2$ for mounting exhibition articles above the aseismatic mount A and the supporting beams 101 and 101, can be maintained horizontally. Each of the aseismatic mounts A arranged beneath the base plate $B_2$ for mounting exhibition articles, is fixed onto the lift mechanism 200 which is arranged on the floor $W_1$ of the lower mount frame 1, and the middle mount frame 2 is swingable in the front and rear directions by means of the lower aseismatic means 4 which is arranged in the right and left directions between the lower mount frame 1 and the middle mount frame. Further, the upper mount frame 3 is swingable in the front and rear directions by means of the upper aseismatic means 4 which is arranged in the front and rear directions between the middle mount frame 2 and the upper mount frame.

Next, when an earthquake happens, the vibration detector 44 detects it, in the same manner as mentioned above, so as to release magnetization of the the trigers 33 and 33*a,* and then the rod 37 goes into the cylinder 35 by means of the force of the spring 36, so that the engagement of the rod with the engaging openings 41 and 41*a* can be released. Then, the middle mount frame 2 becomes movable, via the aseismatic means 4, in right and left horizontal directions with respect to the lower mount frame 1 which is fixed to the surface of installation, and the upper mount frame 3 becomes movable, via the aseismatic means 4, in front and rear horizontal directions, with respect to the middle mount frame 2. It is possible that the middle mount frame 2 becomes movable in front and rear horizontal directions with respect to the lower mount frame 1, via the aseismatic means 4 having the rollers 42 of an eccentric axis, and the upper mount frame 3 becomes movable, in front and rear horizontal directions with respect to the middle mount frame 2, via the aseismatic means 4 having the rollers 42 of an eccentric axis.

When the lower mount frame 1 shakes and reciprocates in the directions of vibration together with the installation surface at the time of an earthquake, the vibration or shake is absorbed and reduced via the aseismatic means 4 which is arranged to roll in the directions of vibration as mentioned above, so that it may prevent the vibration from transmitting to the base plate $B_2$ of mounting exhibition articles on the aseismatic mount A having the aseismatic means 4.

When inspection or exchange of the aseismatic mount A, is carried out, the cover 205 of the lift mechanism 200 which lift mechanism is arranged beneath the both sides of the aseismatic mount A and supports all of the weight except the main body $B_1$ of the showcase, is lowered by operation of the handle in the above-mentioned manner, and thereafter it may take out the cover 205 from the clearance between the floor $W_1$ and the base plate $B_2$ of mounting exhibition articles. In practically, the lift mechanism 200*a* of the fixing means 300 of the both sides of the supporting beams 101 and 101, is operated by the handle so as to lower the cover 205, so that catch of the connecting member 36 on the side of the aseismatic mount A with respect to the lateral groove member 301 of the fixing means 300, can be released. Thereafter, the cover 205 of the lift mechanism 200 on the side of the aseismatic mount A is lowerd by handle operation, so that the aseismatic mount A is lowered and the wheel 90 attached to the undersurface thereof, contacts with the floor $W_1$. On the other hand, the supporting beams 101 and 101 are also lowered integrally and contact the floor with the stand member 102. As the result, it brings about such a state that the base plate $B_2$ of mounting exhibition articles may be supported by means of the supporting beams 101 and 101, and thereafter the aseismatic mount A may be taken out from the clearance.

The foregoing relates to preferred exemplary embodiments of the invention, it being understood that other variants and embodiments thereof are possible within the spirit and scope of the invention, the latter being defined by the appended claims.

What is claimed is:

1. An aseismatic mount for exhibition of articles comprising:

a lower mount frame, at least one lower guide member fixed to the lower mount frame, a middle mount frame, an upper mount frame for mounting exhibition articles thereon, at least one upper guide member fixed to the upper mount frame, a plurality of first aseismatic means each having rollers integrally along rotational axes of each roller, each of said rollers being shifted eccentrically in up and down directions relative to each other, said plurality of first aseismatic means being interposed between the lower guide member and the middle mount frame at plural positions, wherein at least one of said rollers of each said first aseismatic means which is shifted eccentrically upwards rolls in contact with the lower guide member, and one of said rollers of each said first aseismatic means which is shifted eccentrically downwards rolls in contact with the middle mount frame, and a plurality of second aseismatic means having the same construction as said first aseismatic means, said plurality of second aseismatic means being interposed between the middle mount frame and the upper guide member at plural positions such that rolling directions of the rollers of said second aseismatic means are in a direction perpendicular to rolling directions of the rollers of said first aseismatic means, wherein at least one of said rollers of each said second aseismatic means which is shifted eccentrically upwards rolls in contact with the middle mount frame, and one of said rollers of each said second aseismatic means which is shifted eccentrically downwards rolls in contact with the upper guide member.

2. The aseismatic mount for exhibition of articles as claimed in claim 1, further comprising:

a rack provided integrally on faces of each of the upper and lower guide members along longitudinal directions of the guide members, a first pinion provided integrally with the one roller of each first aseismatic means shifted eccentrically upwards, which roller rolls on the lower guide member, so as to engage with the rack of the lower guide member, and a second pinion provided integrally with the one roller of each second aseismatic means shifted eccentrically downwards, which roller rolls on the upper guide member, so as to engage with the rack of the upper guide member.

3. The aseismatic mount for exhibition of articles as claimed in claim 2, wherein a pair of the rollers of each of the first and second aseismatic means integrally combines a roller of a small diameter and a roller of a large diameter which are shifted eccentrically in up and down directions respectively.

4. The aseismatic mount for exhibition of articles as claimed in claim 2, wherein a pair of the rollers of each of the first and second aseismatic means integrally combines each of the rollers having a same diameter.

5. The aseismatic mount for exhibition of articles as claimed in claim 2, wherein the lower mount frame, the middle mount frame, and the upper mount frame for mounting exhibition articles thereon each comprise connecting members and mount frame members which are combined such that said aseismatic means are positioned between the mount frames at corners where the connecting members and the mount frame members cross each other.

6. The aseismatic mount for exhibition of articles as claimed in claim 1, further comprising:

a showcase, said showcase being mounted on the upper mount frame, wherein the lower mount frame of the aseismatic mount for exhibition of articles is fixed onto an installation face.

7. The aseismatic mount for exhibition of articles as claimed in claim 6, further comprising:

a rectangular outer frame integrally provided with each of the lower mount frames, the middle mount frame and the upper mount frame of the aseismatic amount for exhibition of articles, each said rectangular outer frame being formed in a same shape as four walls of the showcase in plan view, so as to form a skirt portion of the showcase with these outer frames, and also form a vertical clearance between adjacent outer frames of the mount frames, so as to allow the mount frames to move relatively in horizontal directions.

8. The aseismatic mount for exhibition of articles as claimed in claim 7, wherein the showcase comprises a main body of the showcase fixed to a wall of a structure and a mount plate for mounting exhibition articles which plate is separated from the showcase at a lower end of an opening of the main body of the showcase, said aseismatic mount comprising a plurality of said upper, lower and middle mount frames positioned below the mount plate along a longitudinal direction of the mount plate leaving a predetermined distance therebetween, so as to support the mount plate by means of each upper mount frame.

* * * * *